US005769095A

United States Patent [19]

Schramm

[11] Patent Number: 5,769,095

[45] Date of Patent: Jun. 23, 1998

[54] METHOD OF AND APPARATUS FOR FILLING TUBULAR WRAPPERS WITH SMOKABLE MATERIAL

[75] Inventor: Christian Schramm, Evry, France

[73] Assignee: Chilinov s.a.r.l., Chilly-Mazarin, France

[21] Appl. No.: 664,248

[22] Filed: Jun. 7, 1996

[30] Foreign Application Priority Data

Jun. 10, 1995 [DE] Germany ..... 195 21 180.4

[51] Int. Cl.[6] ..... A24C 5/42

[52] U.S. Cl. ..... 131/70; 131/72; 131/280

[58] Field of Search ..... 131/70, 72, 280

[56] References Cited

U.S. PATENT DOCUMENTS

| | | | |
|---|---|---|---|
| 4,215,705 | 8/1980 | Marcil | 131/70 |

FOREIGN PATENT DOCUMENTS

| | | | |
|---|---|---|---|
| 0 144 060 | 6/1985 | European Pat. Off. . | |
| 96 10 8233 | 10/1996 | European Pat. Off. . | |
| 370970 | 2/1907 | France . | |
| 115243 | 5/1899 | Germany . | |
| 146035 | 8/1902 | Germany . | |
| 398521 | 5/1920 | Germany . | |
| 447188 | 7/1927 | Germany . | |
| 464347 | 8/1928 | Germany | 131/72 |
| 34 07 301 | 10/1984 | Germany . | |
| 44 33 848 A 1 | 3/1996 | Germany . | |
| 44 33 850 A 1 | 3/1996 | Germany . | |
| 170950 | 11/1921 | United Kingdom | 131/70 |
| 255414 | 9/1926 | United Kingdom . | |

*Primary Examiner*—V. Millin
*Attorney, Agent, or Firm*—Darby & Darby

[57] ABSTRACT

Successive tubular wrappers of cigarette paper, which are conveyed sideways in the peripheral flutes of ail indelible rotary conveyor, receive elongated batches of smokable material during intervals of dwell at a filling station. The batches are introduced by an elongated channel-shaped implement which is reciprocable with a batch into, and without a batch out of, a wrapper at the filling station. The wrappers are propped by the concave surface of a pivotable holder during introduction of batches and the batch-receiving open ends of the wrappers are calibrated by causing them to move axially into a cylindrical portion of a passage in a mouthpiece at the filling station immediately prior to introduction of the batches.

21 Claims, 3 Drawing Sheets

METHOD OF AND APPARATUS FOR FILLING TUBULAR WRAPPERS WITH SMOKABLE MATERIAL

BACKGROUND OF THE INVENTION

The invention relates to improvements in methods of and in apparatus for introducing smokable material into prefabricated tubular envelopes or wrappers (hereinafter called wrappers). More particularly, the invention relates to improvements in methods of and in apparatus for inserting elongated batches or plugs (hereinafter called batches) of smokable material (such as comminuted natural, reconstituted and/or artificial tobacco) into wrappers which can contain or consist of cigarette paper or analogous combustible wrapping material for rod-like tobacco fillers.

German patent No. 398 521 discloses an apparatus wherein a rotary drum transports empty wrappers to a filling station. An empty wrapper which reaches the filling station is moved axially so that one of its ends receives a substantially beak- or snout-shaped nozzle having a passage for the introduction of a rod-like tobacco filler into the wrapper. The freshly filled wrapper is retracted off the nozzle and is transported away to provide room for an empty wrapper at the filling station.

A drawback of the patented apparatus is that its output is relatively low. Furthermore, the nozzle is likely to further deform and/or damage and/or destroy the open end of the empty wrapper during entry into such open end, particularly if the open end of the wrapper is somewhat deformed or damaged at the time it reaches the filling station. Still further, the quality of rod-shaped smokers' products which can be turned out by the patented apparatus is not always and not entirely satisfactory.

OBJECTS OF THE INVENTION

An object of the invention is to provide a novel and improved method of introducing smokable material into prefabricated elongated tubular envelopes of cigarette paper and/or other wrapping material for comminuted natural, reconstituted and/or artificial tobacco.

Another object of the invention is to provide a method which renders it possible to turn out large quantities of high-quality smokers' products per unit of time.

A further object of the invention is to provide a method which renders it possible to turn out high-quality rod-shaped smokers' products (such as filter cigarettes) even if the condition of empty wrappers which are to receive batches of smokable material departs from an ideal condition.

An additional object of the invention is to provide a method which renders it possible to correct the condition (such as the shape) of empty tubular wrappers prior to introduction of smokable material.

Still another object of the invention is to provide a novel and improved apparatus for the practice of the above outlined method.

A further object of the invention is to provide the apparatus with novel and improved means for manipulating tubular wrappers at the station where the wrappers are to receive charges or batches of smokable material.

Another object of the invention is to provide the apparatus with novel and improved means for holding and/or propping the wrappers during introduction of smokable material.

An additional object of the invention is to provide the apparatus with novel and improved means for calibrating and positioning tubular wrappers at the filling station.

Still another object of the invention is to provide an apparatus which can turn out larger quantities of filter cigarettes or analogous rod-shaped smokers' products per unit of time than heretofore known apparatus which are used to introduce batches of smokable material into prefabricated tubular wrappers.

A further object of the invention is to provide an apparatus which can turn out high-quality rod-shaped smokers' products of the type wherein prefabricated tubular envelopes are filled with elongated batches of smokable material.

SUMMARY OF THE INVENTION

One feature of the present invention resides in the provision of a method of filling tubular wrappers with smokable material. The improved method comprises the steps of conveying a series of successive elongated empty tubular wrappers sideways (i.e., transversely of their lengths) along a predetermined path (preferably along an arcuate path) to a filling station, introducing elongated batches (e.g., in the form of elongated cylindrical plugs or wads) of smokable material into successive wrappers at the filling station including advancing a batch by an inserting tool lengthwise into the wrapper at the filling station and thereupon withdrawing the tool from the thus filled wrapper, and thereafter advancing successive filled wrappers beyond the filling station.

The wrappers can contain (or consist of) cigarette paper, and the batches can contain comminuted natural, artificial and/or reconstituted tobacco.

The conveying step can include introducing the empty wrappers into axially parallel peripheral flutes of a rotary conveyor (e.g., a drum-shaped conveyor) and indexing the conveyor about a predetermined axis to thereby advace successive wrapper-containing flutes along the predetermined path to the filling station.

The conveying step can further include maintaining a first section of each wrapper (e.g., an elongated substantially semicylindrical trough-shaped section) of each wrapper in contact with the conveyor at the respective flute, and such method can further comprise the step of propping a second section of the wrapper (preferably a second elongated substantially semicylindrical trough-shaped section) of the wrapper at the filling station at least in the course of the respective introducing step. The first sections are preferably located at least substantially diametrically opposite the second sections of the respective wrappers.

The empty wrappers which are being conveyed toward the filling station have material-receiving open ends and second ends which may but need not be open (for example, each second end can be connected with or can contain a filter mouthpiece), and the method can further comprise the step of calibrating the open ends of successive wrappers at the filling station prior to the respective introducing step. The calibrating step can include, moving the wrappers longitudinally in the respective flutes so that the open ends of the thus moved wrappers enter an at least substantially cylindrical calibrating passage.

The method can further comprise the step of establishing a stop for the second ends of successive wrappers at the filling station in the course of the respective introducing step. Such stop constitutes or can constitute a component part of the means for calibrating the open ends of the empty wrappers at the filling station.

Another feature of the invention resides in the provision of an apparatus for filling tubular wrappers with smokable material. In its presently preferred form, the apparatus comprises means for conveying a series of successive elongated empty tubular wrappers sideways (i.e., transversely of their lengths) along a predetermined path (preferably along an arcuate path) to and thereupon beyond a filing station, and means for introducing elongated batches of smokable material (e.g., elongated rod-shaped plugs consisting of natural, reconstituted and/or artificial tobacco) into successive empty wrappers at the filling station, The means for introducing includes a tool which is located at the filling station and is movable with a batch of smokable material into, and without the batch from, the wrapper at the filing station prior to the conveying of the thus filled wrapper beyond the filling station.

The means for conveying can comprise a rotary conveyor (such as a drum) which is indexible about a predetermined axis and has substantially axially parallel peripheral receptacles (e.g., in the form of flutes or the like) for the advancement of empty wrappers to and of filled wrappers beyond the filling station. Such apparatus further comprises means for supplying elongated batches of smokable material to the tool at the filling station upon movement of the tool from a freshly filled wrapper at the filling station.

The apparatus can further comprise means for propping the wrappers at the filling station, at least in the course of movement of the tool into the wrapper at the filling station. The means for propping can include at least one holder or support or abutment, and means for moving such holder or support or abutment relative to the wrapper at the filling station. As a rule, or at least in many instances, the tubular wrappers have substantially cylindrical external surfaces, and the means for propping can be provided with a wrapper-engaging substantially concave surface having a radius of curvature which equals or at least approximates the radii of curvature of the substantially cylindrical external surfaces of the tubular wrappers.

The tool can comprise or constitute an elongated channel for discrete batches of smokable material, and the length of such channel can equal or approximate the length of the tubular wrappers.

Each tubular wrapper has an open first end and a second end which may but need not be open (i.e., accessible). The apparatus can further comprise means for calibrating the open ends of the wrappers on the conveying means prior to movement of the tool into the wrappers at the filling station. The calibrating means can comprise a mouthpiece or an analogous component which is disposed at the filling station and defines a passage including an at least substantially cylindrical portion and an at least substantially frustoconical portion located between the at least substantially cylindrical portion and the conveyor means and tapering (i.e., diminishing in diameter) in a direction toward the at least substantially cylindrical portion. Such calibrating means preferably further comprises a stop provided at the second end of the wrapper at the filling station and being movable to advance the open end of the wrapper at the filling station through the at least substantially frustoconical portion and into the at least substantially cylindrical portion of the passage in the mouthpiece. The stop can include a reciprocable pusher and is retractable in a direction away from the mouthpiece. The tool can include means for moving the open end of the filled wrapper out of the mouthpiece toward the retracted stop upon completion of the calibrating operation, namely in the course of or after the insertion of smokable material into the empty wrapper at the filling station.

The apparatus further comprises means for supplying to the flutes of the conveying means empty wrappers upstream of the filling station, for example, empty wrappers which contain or consist of cigarette paper, The novel features which are considered as characteristic of the invention are set forth in particular in the appended claims. The improved apparatus itself, however, both as to its construction and the method of using the same, together with numerous additional features and advantages thereof, will be best understood upon perusal of the following detailed description of certain presently preferred specific embodiments with reference to the accompanying drawings.

11 and shows the holder in the operative position of engagement with the adjacent section of the external surface of the feshly filled wrapper.

DESCRIPTION OF PREFERRED EMBODIMENTS

Figure 1:
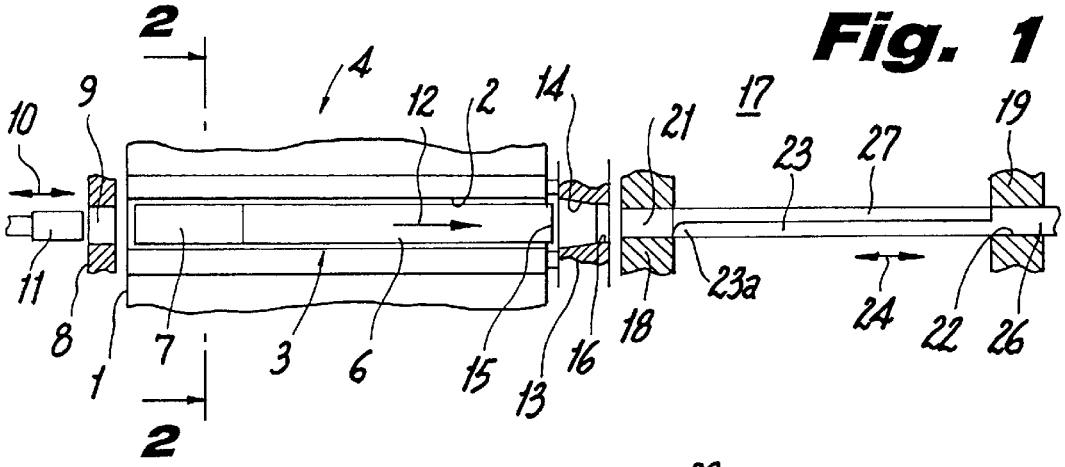
FIG. 1 is a fragmentary elevational view of an apparatus which embodies one form of the invention, an empty tubular wrapper at the filling station being ready to undergo a calibrating treatment prior to receiption of a batch of smokable material, and the implement or tool for introduction of batches of smokable material into successive calibrated wrappers at the filling station being shown in its retracted position.
Figure 2:
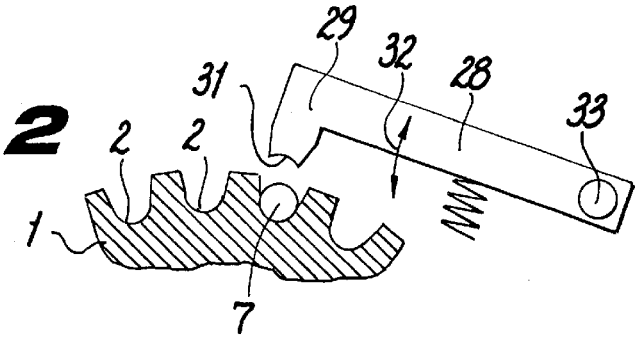
FIG. 2 is a fragmentary sectional view substantially as seen in the direction of arrows from the line A—A in FIG. 1, a pivotable propping device or holder for tubular wrappers during reception of batches of smokable material being shown in a retracted or inoperative position.

Referring first to FIGS. 1 and 2, the improved apparatus comprises a conveyor including an indexible rotary drum 1 having a plurality of axially parallel receptacles in the form of elongated flutes 2 machined into or otherwise formed in its peripheral surface. Successive flutes 2 receive discrete elongated empty tubular wrappers 3 which receive batches or plugs 27 of smokable material (such as natural, reconstituted and/or artificial tobacco) during dwell at a filling or introducing station 4. Each wrapper 3 preferably contains or consists of cigarette paper or other suitable combustible wrapping material for rod-like fillers of smokable material. The wrapper 3 which is shown in FIG. 1 comprises an elongated cylindrical portion having an open end 15 and a second end formed by a filter mouthpiece or filter plug 7 which is adhesively secured to the adjacent part of the cylindrical portion. The flutes 2 serve to advance the respective wrappers 3 sideways, i.e., transversely of their lengths.

The manner in which prefabricated empty tubular wrappers can be supplied into successive flutes of a rotary drum-shaped conveyor which is indexible about a predetermined axis is fully disclosed in the commonly owned copending German patent application Serial No. P 44 33 850.3, filed Sep. 22, 1994, to which reference may be had, if necessary. This German patent application corresponds to U.S. patent application Ser. No. 08/528,239 filed Sep. 14, 1995; the disclosure of the Ser. No. 08/528,239 is incorporate herein by reference. As already mentioned above, the empty wrappers 3 are fed into successive empty flutes 2 upstream of the filling station 4 so that each flute which comes to rest at such station contains an empty wrapper ready to receive a plug or batch or filler 27 of smokable particulate material.

The left-hand end face of the drum 1 (as seen in FIG. 1) is adjacent a disc-shaped guide 8 having a bore or hole 9 for a stop or pusher 11 which is reciprocable (e.g., by a non-illustrated double-acting fluid-operated cylinder and piston unit) in directions indicated by a double-headed arrow 10. The pusher or stop 11 is aligned with and can enter the adjacent end of that flute 2 which is located at the filling station 4 during the respective interval of dwell of the drum. The purpose of the pusher or stop 11 (hereinafter called pusher) is to shift the aligned mouthpiece 7 axially from the position of FIG. 1 to the position shown in FIG. 3 in order to move the open end 15 of the empty wrapper 3 at the filling station 4 first through a substantially frustoconical portion 14 and thereupon into a substantially cylindrical portion 16 of an aligned passage in a stationary mouthpiece 13 adjacent the right-hand end face of the drum 1 (as viewed in FIGS. 1 and 3), The direction in which the pusher 11 can shift a wrapper 3 at the station 4 is indicated by an arrow 12. The substantially frustoconical portion 14 of the passage in the mouthpiece 13 tapers (i.e., its diameter decreases) toward the cylindrical portion 16. The pusher 11 and the mouthpiece 13 together constitute a simple but reliable calibrating unit which can restore the desired shape of a slightly (or even appreciably) deformed end portion 15 immediately or shortly before the hollow cylindrical portion of the respective wrapper 3 receives a batch or plug 27 of smokable material. The maximum diameter of the substantially frustoconical portion 14 of the passage in the mouthpiece 13 at least slightly exceeds the desired diameter of a properly configurated end portion 15, and the diameter of the substantially cylindrical portion 16 of this passage preferably equals or closely approximates such desired or ideal diameter, The reference characters 18 and 19 denote in FIG. 1 two spaced-apart walls of a housing wherein a mechanism 17 serves to supply successive discrete batches or plugs 27 of smokable material into a mobile inserting implement or tool 23 which is reciprocable (in directions indicated by a double-headed arrow 24) by a piston 26 of a fluid-operated motor or any other suitable prime mover between a first or retracted end position shown in FIGS. 1, 3 and 11, and a second or extended position shown in FIG. 9. The mouthpiece 13 is located between the adjacent end face of the drum 1 and the wall 18 of the housing for the mechanism 17, The wall 18 has an opening 21 which is aligned with the passage of the mouthpiece 13 and is dimensioned in such a way that it enables the tool 23 as well as a batch 27 to pass therethrough and through the (already calibrated) open end 15 of a wrapper 3 which is then located at the filling station 4 in an axial position corresponding to that shown in FIGS. 3 and 5. The wall 19 has an opening 22 which is aligned with the opening 21 of the wall 18 (i.e., with the passage of the mouthpiece 13) and is large enough to permit unimpeded reciprocation of the piston 26 in the directions indicated by the double-headed arrow 24.

Figure 3:
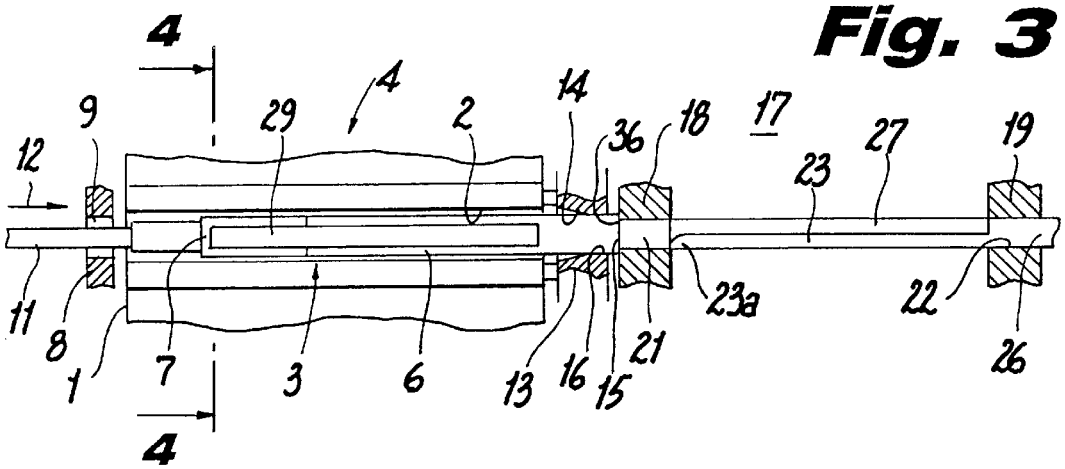
FIG. 3 illustrates the structure of FIG. 1 and a portion of the holder in the latter's operative or wrapper-engaging position, and an empty wrapper in an axial position it assumes upon completion of the calibrating step.
Figure 5:
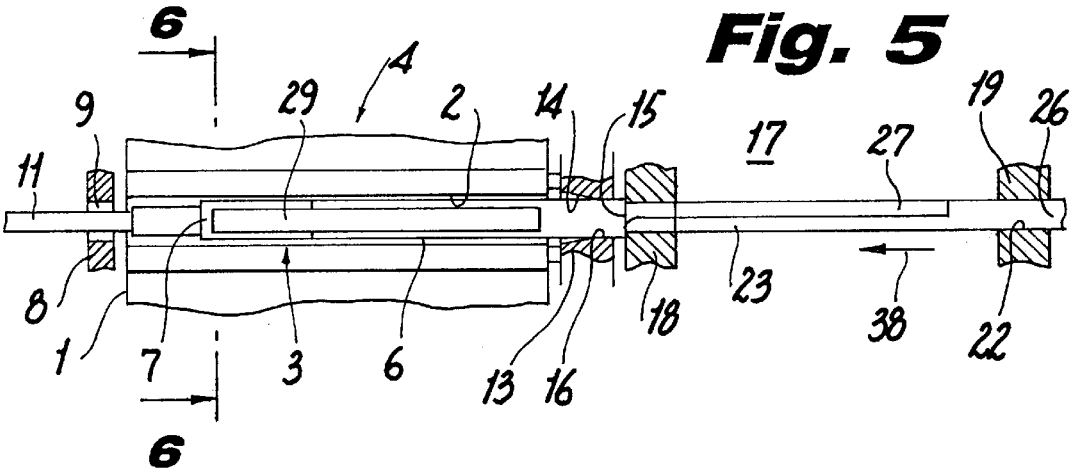
FIG. 5 shows the structure of FIG. 3, with the empty wrapper at the filling station in the axial position it assumes upon completion of the calibrating step and with the tool and the batch of smokable material therein on their way into the interior of the wrapper.
Figure 7:
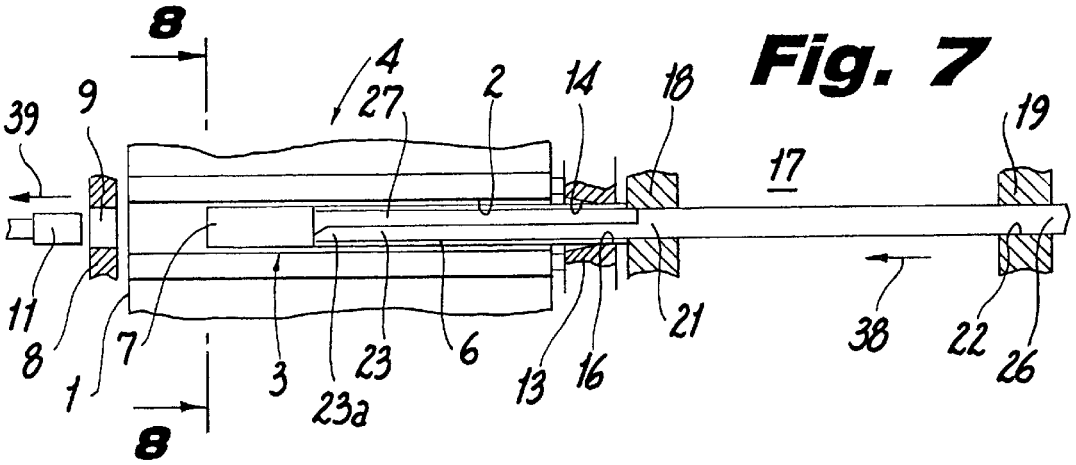
FIG. 7 illustrates the structure of FIG. 5 but with the tool and the batch of smokable material therein during a further stage of penetration into the wrapper at the filling station, the wrapper being shown in the process of axial movement with the tool toward a retracted stop of the calibrating mechanism.
Figure 9:
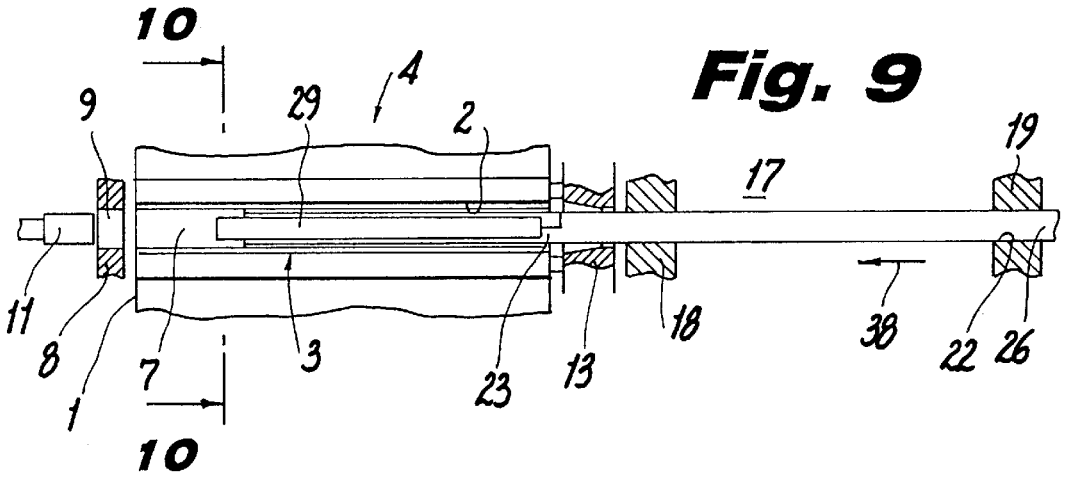
FIG. 9 shows the structure of FIG. 7 but with the freshly filled wraper back in or close to the axial position of FIG. 1 and with the tool in the fully extended position still in the interior of the freshly filled wrapper.
Figure 11:
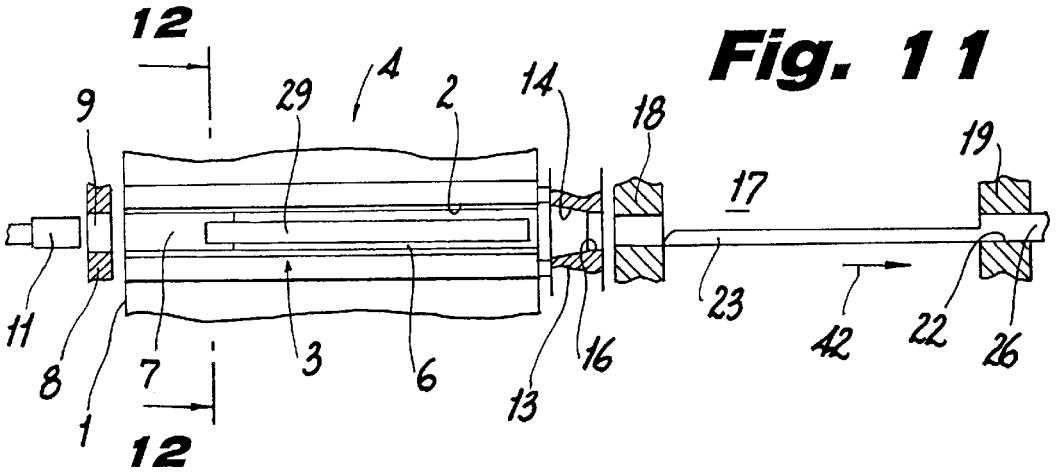
FIG. 11 shows the structure of FIG. 9 with the tool in the fully extracted position and the freshly filled wrapper ready to be advanced beyond the filling station.
Figure 12:
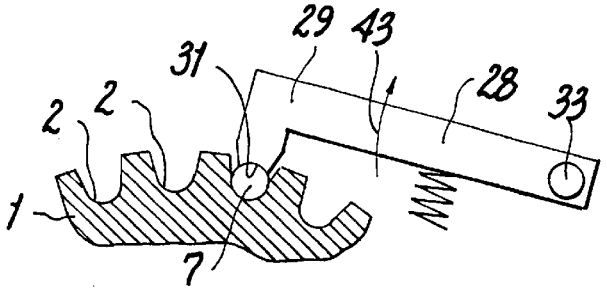
FIG. 12 is a fragmentary sectional view substantially as seen in the direction of arrows from the line A—A of FIG.

The left-hand end portion (as viewed in FIGS. 1, 3, 5, 7, 9 and 11) or tip 23*a* of the tool 23 constitutes a means for moving a freshly filled wrapper 3 from the axial position of FIG. 3, 5 or 7 to the axial position of FIG. 9 or 11, i.e., back to or at least close to the starting axial position shown in FIG. 1. At least that elongated part of the tool 23 which is to penetrate into the cylindrical portions of empty wrappers 3 at the filling station constitutes or resembles a channel or trough which can receive a portion of a batch 27 in such a way that the channel and the batch therein can advance through the opening 21 of the wall 18 and through and beyond the open end 15 of the cylindrical portion of that wrapper 3 which is then located at the filling station and assumes an axial position corresponding to that of the wrapper shown in FIGS. 3 and 5. For example, the batch 27 can constitute a rod-like filler of comminuted tobacco leaf laminae or a mixture of comminuted tobacco leaf laminae with comminuted tobacco ribs. The length of that part of the tool 23 which penetrates into successive empty wrappers 3 at the filling station 4 preferably equals or at least closely approximates the length of an empty wrapper 3 and more particularly the distance between the open end 15 and the filter mouthpiece 7 of a wrapper. This ensures that the tool 23 can move a freshly filled wrapper 3 axially from the position shown in FIG. 3, 5 or 7 to the position shown in FIG. 9 or 11. The pusher 11 is or can be withdrawn (see FIGS. 7, 9 and 11) when a freshly filled wrapper 3 is being pushed by the tip 23*a* of the tool 23 while the tool advances to the left from the position of FIG. 7 to that shown in FIG. 9, The cylindrical portions of the wrappers 3 shown in the drawings are denoted by the characters 6.

The manner in which the mechanism 17 in or at the housing including the walls 18 and 19 forms and/or supplies successive batches 27 of smokable material to the tool 23 is fully described in the commonly owned copending German patent application Serial No. P 44 33 848.1, filed Sep. 22, 1994, to which reference may be had if necessary. This German patent application corresponds to U.S. patent application Ser. No. 08/528,240 filed Sep. 14, 1995; the disclosure of the Ser. No. 08/528,240 is incorporated herein by reference.

FIGS. 2, 4, 6, 8, 10 and 12 show certain details of a mechanism which serves as a means for propping that section of the cylindrical external surface of a wrapper portion 6 which is located at the filling station 4. As can be seen in FIGS. 2, 4, 6, 8, 10 and 12, the propping means includes a holder 29 having a concave surface 31 and being movable between a retracted position shown in FIGS. 2 and 8 (in which the holder 29 does not interfere with the indexing of the drum 1) and an extended position (shown in FIGS. 4, 6, 10 and 12) in which the concave surface 31 abuts or is at least very closely adjacent the exposed section of the external surface of the wrapper portion 6 at the filling station 4. Such exposed section of the external surface is located diametrically opposite the cylindrical section in the flute 2 at the station 4, i.e., opposite the cylindrical section which is in contact with the drum 1.

Figure 4:
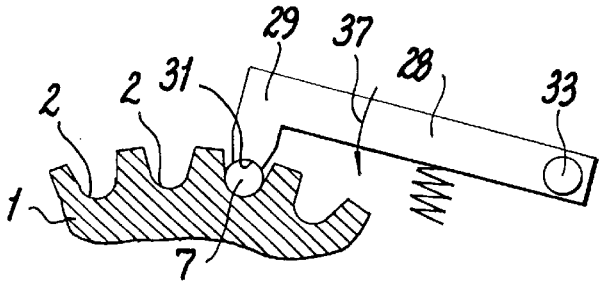
FIG. 4 is a fragmentary transverse sectional view substantially as seen in the direction of arrows from the line A—A in FIG. 3 and shows the concave surface of the holder in actual contact with the adjacent section of the external surface of an empty wrapper at the filling station.

The holder 29 is connected to or forms an integral part of a one-armed lever 28 which is pivotable back and forth (note the double-headed arrow 32 shown in FIG. 2) and whose pivotal movement in the direction of the arrow 37 shown in FIG. 4 is opposed by one or more resilient elements, e.g., coil springs one of which is shown in each of FIGS. 2, 4, 6, 8, 10 and 12. The means for pivoting the lever 28 for the holder 29 includes a shaft 33 which can receive motion from a suitable motor, transmission or the like, not shown. The radius of curvature of the concave surface 31 of the holder 29 can equal or approximate the radius (of curvature) of the normally cylindrical external surface of the wrapper portion 6 at the filling station 4.

The mode of operation of the improved apparatus is as follows:

The cylindrical portions 6 of the wrappers 3 are assumed to transmit light so as to facilitate the observation of various positions of the tool 23 and a batch 27 during different stages of introduction into a portion 6 at the filling station 4. A comparison of FIGS. 1 and 3 will show that one of the steps which are carried out when a fresh (empty) wrapper 3 reaches and comes to a temporary halt at the filling station 4 involves an axial movement of the pusher 11 in the direction of the arrow 12 shown in FIG. 3. This causes the pusher 11 to engage and shift the adjacent filter mouthpiece 7 (i.e., the entire wrapper 3) relative to the respective flute 2 of the drum 1 so that the open end 15 of the tobacco-receiving portion 6 at the station 4 is automatically calibrated by moving first into and through the substantially frustoconical portion 14 and thereupon into the at least substantially cylindrical portion 16 of the mouthpiece 13. Calibration of the end portion 15 (such as elimination of eventual deviations from a truly cylindrical shape) can begin in the at least substantially frustoconical portion 14, and the thus at least partially calibrated end portion 15 is thereupon stabilized as a result of confinement in the at least substantially cylindrical portion 16 of the passage in the mouthpiece 13 during introduction of the tool 23 and a batch 27 into the wrapper portion 6. For example, the surface surrounding the at least substantially frustoconical portion 14 of the passage in the mouthpiece 13 can readily convert a substantially oval end portion 15 into a substantially cylindrical end portion or into a less oval end portion which is more readily insertable into the at least substantially cylindrical portion 16. The end portion 15 of a wrapper 3 which has reached its right-hand end position can abut the adjacent surface 36 (see FIG. 3) of the wall 18.

The holder 29 is pivoted from the position of FIG. 2 to the position of FIG. 4 prior to or during axial movement of the wrapper 3 at the filling station 4 from the position of FIG. 1 to the position of FIG. 3. When the pivoting of the holder 29 in the direction of the arrow 37 shown in FIG. 4 is completed, the concave surface 31 of the holder either abuts or is immediately adjacent the neighboring exposed section of the external surface of the cylindrical portion 6 in the flute 2 at the filling station 4. As can be seen in FIG. 3, the holder 29 and its concave surface 31 are elongated so that the surface 31 can contact and guide and stabilize a major part of the wrapper 3 in the flute 2 at the filling station 4.

Figure 6:
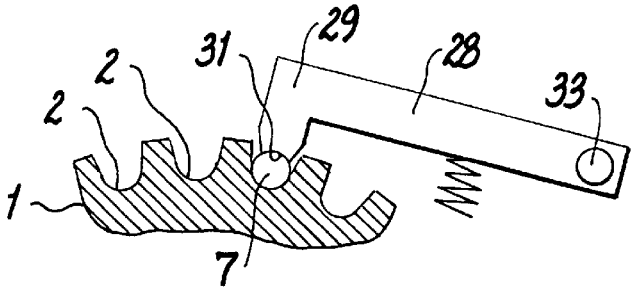
FIG. 6 is a fragmentary sectional view substantially as seen in the direction of arrows from the line A—A of FIG. 5 and shows the holder in the operative position of FIG. 4.

FIGS. 5 and 6 illustrate the initial stage of a wrapper filling or batch introducing or inserting step, The tool 23 and the batch 27 in its channel are on their way into the interior of the cylindrical portion 6 of the wrapper 3 at the filling station 4. The piston 26 is in the process of advancing in the direction of the arrow 38 while the concave surface 31 of the holder 29 lies against the adjacent section of the external surface of the wrapper 3. The pusher 11 is still maintained in the extended position in which it abuts the adjacent exposed end face of the filter mouthpiece 7 to hold the wrapper 3 against movement in the direction of the arrow 38. The surface 31 of the holder 29 cooperates with the surface surrounding the at least substantially cylindrical portion 16 of the passage in the mouthpiece 13 to stabilize the wrapper 3 during insertion of the tool 23 and the batch 27 into the cylindrical portion 6 of such wrapper.

Figure 8:
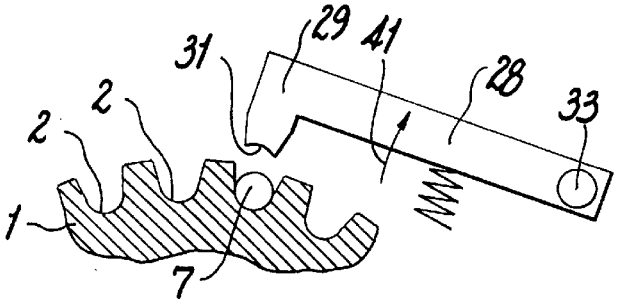
FIG. 8 is a fragmentary transverse sectional view as seen in the direction of arrows from the line A—A in FIG. 7 and shows the holder in the inoperative position of FIG. 2.

FIGS. 7 and 8 show the tool 23 in an intermediate position, i.e., when the introduction of the batch 27 into the cylindrical portion 6 of the wrapper 3 at the filling station 4 is completed. The tip 23*a* of the channel of the tool 23 abuts the right-hand end face of the filter mouthpiece 7 and the pusher 11 is retracted so that it does not interfere with axial movement of the freshly filled wrapper 3 from the axial position of FIG. 7 to the left-hand end position shown in FIGS. 9, 11 and 1. Of course, it is also possible to utilize the tip 23*a* of the channel of the tool 23 as a means for moving the pusher 11 (by way of the mouthpiece 7) in the direction of arrow 39 toward the retracted position of FIGS. 7, 9, 11 and 1. The surface 31 of the holder 29 is preferably pivoted away from the freshly filled wrapper 3 (see FIG. 8) before or while the latter is caused to move axially from the position of FIG. 7 to the position of FIG. 9. The direction in which the holder 29 is pivoted away from the freshly filled wrapper 3 at the station 4 is indicated in FIG. 8 by an arrow 41.

Figure 10:
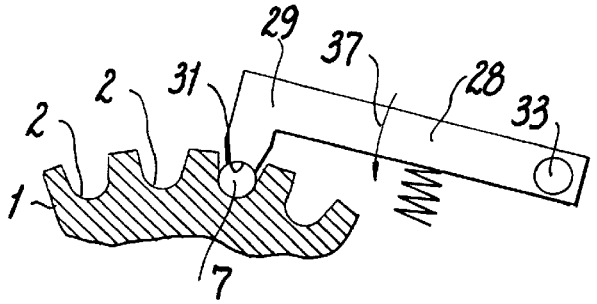
FIG. 10 is a fragmentary sectional view substantially as seen in the direction of arrows from the line A—A in FIG. 9 and shows the holder in the operative position preparatory to extraction of the tool from the freshly filled wrapper at the filling station.

FIG. 9 illustrates the tool 23 in its left-hand end position, i.e., after the tip 23*a* has pushed the mouthpiece 7 (and hence the entire freshly filled wrapper 3) from the axial position of FIG. 7 toward the retracted pusher 11 so that the wrapper assumes an axial position at least close to that shown in FIG. 1. As shown in FIG. 10, the surface 31 of holder 29 is again immediately adjacent the exposed section of the external surface of the freshly filled wrapper 3 so that the latter is stabilized (i.e., properly retained in its axial position relative to the corresponding flute 2 of the drum 1) during the immediately following extraction of the tool 23 and its tip 23*a* from the cylindrical portion 6 of the freshly filled wrapper. During such extraction, the channel of the tool 23 moves in the direction of the arrow 42.

Referring to FIG. 11, the tool 23 is shown in the fully retracted position (upon completion of the movement in the direction of the arrow 42) in which the channel of such tool is ready to receive from the mechanism 17 a fresh batch 27 for introduction into the cylindrical portion 6 of the empty wrapper 3 which reaches the filling station 4 in response to indexing of the drum 1 for the purpose of moving the freshly filled wrapper beyond the filling station. The holder 29 is moved from the operative position of FIG. 12 in the direction of the arrow 43 prior to indexing of the drum 1 for the purpose of advancing the freshly filled wrapper 3 beyond the filling station. The aforedescribed series of steps is thereupon repeated as often as necessary to turn out a desired number of successive filled wrappers 3. Such filled wrappers are ready for transport into storage or to a packing machine, not shown.

An important advantage of the improved method and apparatus is their simplicity. Furthermore, the apparatus can be used to turn out large quantities of filled wrappers per unit of time and the quality of such filled wrappers is superior to that of wrappers which are filled in heretofore known apparatus. This is attributable to the provision of the holder 29 and to the configuration of its concave surface 31, as well as to the provision of the calibrating mechanism including the pusher 11 and the mouthpiece 13. The tool 23 exhibits the advantage that its channel can reliably guide a batch 27 on its way into the cylindrical portion 6 of a wrapper 3 at the filling station 4; in addition, the tool 23 performs the desirable function of causing its tip 23*a* to separate the open end portion 15 of a freshly filled wrapper 3 from the mouthpiece 13 during shifting of such freshly filled wrapper back to its initial axial position.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making cigarettes or the like and, therefore, such adaptations should and are intended to be comprehended within the meaning and range of equivalence of the appended claims.

What is claimed is:

1. A method of filling tubular wrappers with smokable material, comprising the steps of conveying a series of successive elongated empty tubular wrappers transversely of their lengths along a predetermined path to a filling station; introducing elongated batches of smokable material into successive wrappers at said station, including advancing a batch by an inserting tool lengthwise into the wrapper at said station and thereupon withdrawing the tool from the thus filled wrapper; propping the wrapper at said station in the course of the respective batch introducing and tool withdrawing steps; and thereafter advancing successive filled wrappers beyond said station.

2. The method of claim 1, wherein the wrappers contain cigarette paper and said batches constitute elongated plugs containing comminuted tobacco.

3. The method of claim 1, wherein said conveying step includes introducing the empty wrappers into axially parallel peripheral flutes of a rotary conveyor and indexing the conveyor about a predetermined axis to thereby advance successive wrapper-containing flutes along said path to said filling station.

4. The method of claim 3, wherein said conveying step further includes maintaining a first section of each wrapper in contact with the conveyor at the respective flute, said propping step comprising propping a second section of the wrapper at said station at least in the course of the respective batch introducing or tool withdrawing step.

5. The method of claim 4, wherein said first sections are located substantially diametrically opposite the second sections of the respective wrappers.

6. The method of claim 3 of filling tubular wrappers having material-receiving open ends and second ends, further comprising the step of calibrating the open ends of successive wrappers at said filling station prior to the respective introducing step.

7. The method of claim 1 of filling empty tubular wrappers having material-receiving open ends and second ends, further comprising the step of establishing a stop for the second ends of successive wrappers at said filling station at least prior to the respective introducing step.

8. The method of claim 1, wherein said propping step includes propping the wrapper at said station only in the course of the respective batch introducing and tool withdrawing steps.

9. The method of claim 1, further comprising the step of moving the filled wrappers at said station lengthwise by the inserting tool prior to the respective tool withdrawing steps.

10. Apparatus for filling tubular wrappers with smokable material, comprising means for conveying a series of successive elongated empty tubular wrappers transversely of their length along a predetermined path to and thereupon beyond a filling station; means for introducing elongated batches of smokable material into successive empty wrappers at said station, including a tool located at said station and movable with a batch of smokable material into, and without the batch from, the wrapper at said station prior to conveying of the thus filled wrapper beyond said station; and means for propping the wrapper at said station during movement of the tool into and during movement of the tool from the wrapper.

11. The apparatus of claim 10, wherein said means for conveying comprises a conveyor indexible about a predetermined axis and having substantially axially parallel peripheral flutes for advancement of empty wrappers to and of filled wrappers beyond said filling station.

12. The apparatus of claim 10, wherein said means for propping includes at least one holder and means for moving said holder relative to the wrapper at said filling station.

13. The apparatus of claim 10 for filling tubular wrappers having a predetermined length, wherein said tool comprises an elongated channel for discrete batches of smokable material, said channel having a second length at least approximating said predetermined length.

14. The apparatus of claim 10 for filling tubular wrappers of the type having a material receiving open end and a second end, and further comprising means for calibrating the open ends of wrappers on said conveying means prior to movement of said tool into the wrappers at said filling station.

15. The apparatus of claim 10, wherein said propping means includes means for propping the wrapper at said station only during movement of the tool into and during movement of the tool from the wrapper.

16. The apparatus of claim 10, further comprising means for moving said tool to advance successive filled wrappers at said filling station lengthwise prior to movement of the tool out of the filled wrappers.

17. A method of filling tubular wrappers with smokable material, comprising the steps of conveying a series of successive elongated empty tubular wrappers having material-receiving open ends and second ends transversely of their lengths along a predetermined path to a filling station, including introducing the empty wrappers into axially parallel peripheral flutes of a rotary conveyor and indexing the conveyor about a predetermined axis to thereby advance successive wrapper-containing flutes along said path to said filling station; introducing elongated batches of smokable material into successive wrappers at said station, including advancing a batch by an inserting tool lengthwise into the wrapper at said station and thereupon withdrawing the tool from the thus filled wrapper; calibrating the open ends of successive wrappers at said filling station prior to the respective batch introducing steps, including moving the wrappers longitudinally in the respective flutes so that the open ends of the thus moved wrappers enter an at least substantially cylindrical calibrating passage; and advancing successive filled wrappers beyond said station.

18. Apparatus for filling tubular wrappers with smokable material, comprising means for conveying a series of successive elongated empty tubular wrappers having substantially cylindrical external surfaces with first radii of curvature transversely of their lengths along a predetermined path to and thereupon beyond a filling station, said conveying means comprising a conveyor indexible about a predetermined axis and having substantially axially parallel peripheral flutes for advancement of empty wrappers to and of filled wrappers beyond said filling station; means for introducing elongated batches of smokable material into successive empty wrappers at said station, including a tool located at said station and movable with a batch of smokable material into, and without the batch from, the wrapper at said station prior to conveying of the thus filled wrapper beyond said station; and means for propping the wrappers at said filling station at least in the course of movement of said tool into the wrapper at said station, said means for propping having a wrapper-engaging substantially concave surface with a second radius of curvature at least approximating said first radii of curvature.

19. Apparatus for filling tubular wrappers with smokable material, comprising means for conveying a series of successive elongated empty tubular wrappers of the type having a material receiving open end and a second end transversely of their lengths along a predetermined path to and beyond a filling station; means for introducing elongated batches of smokable material into successive empty wrappers at said station, including a tool located at said station and movable with a batch of smokable material into, and without the batch from, the wrapper at said station prior to conveying of the thus filled wrapper beyond said station; and means for calibrating the open ends of wrappers on said conveying means prior to movement of said tool into the wrappers at said filling station, comprising a mouthpiece disposed at said filling station and defining a passage including a substantially cylindrical portion and a substantially conical portion located between said substantially cylindrical portion and said conveying means and tapering toward said substantially cylindrical portion, and a stop provided at the second end of a wrapper at said station and movable to advance the open end of the wrapper at said station through said substantially conical portion and into said substantially cylindrical portion of said passage.

20. The apparatus of claim 19, wherein said stop includes a reciprocable pusher.

21. The apparatus of claim 19, wherein said stop is retractible in a direction away from said mouthpiece and said tool includes means for moving the open end of a filled wrapper out of said mouthpiece toward the retracted stop.

* * * * *